United States Patent [19]

Steinhogl

[11] 4,062,260

[45] Dec. 13, 1977

[54] PRODUCE CUTTER

[76] Inventor: John Steinhogl, 5329 Ruby, Apt. E, Torrance, Calif. 90503

[21] Appl. No.: 723,234

[22] Filed: Sept. 15, 1976

[51] Int. Cl.[2] ..... B26D 7/06; B26D 3/18

[52] U.S. Cl. ..... 83/404.3; 83/425.3; 83/431; 83/437

[58] Field of Search ..... 83/404, 404.1, 404.3, 83/404.4, 408, 417, 425.1, 425.3, 437, 858, 431

[56] References Cited

U.S. PATENT DOCUMENTS

| | | | |
|---|---|---|---|
| 1,046,551 | 12/1912 | Cass | 83/408 |
| 1,668,286 | 5/1928 | Powell | 83/425.1 |
| 2,801,661 | 8/1957 | Miller | 83/425.3 X |
| 2,852,053 | 9/1958 | Berry et al. | 83/437 |
| 3,112,781 | 12/1963 | Popeil | 83/437 |
| 3,807,266 | 4/1974 | Camp | 83/425.3 X |

*Primary Examiner*—Willie G. Abercrombie
*Attorney, Agent, or Firm*—Bruce L. Birchard

[57] ABSTRACT

By providing in a produce cutter a cutting die of non-coplanar cross-sectional configuration which cooperates with the interstices formed by rigidly supported multiple knives the force required to slice or dice produce, such as potatoes, onions or turnips, is significantly reduced, making operations by manual means or low-powered motor means not only feasible but highly attractive.

6 Claims, 4 Drawing Figures

PRODUCE CUTTER

BACKGROUND OF THE INVENTION

1. Field of the Invention

This invention relates to produce cutting apparatus and, more specifically, to vegetable slicing and dicing apparatus.

2. Description of the Prior Art

The prior art reveals various devices for slicing and dicing vegetables and other agricultural produce. For example, such devices are shown in the following U.S. Pat. Nos.: No. 2,572,770, (Shadduck); No. 3,216,474, (Popeil); No. 2,153,407, (Bell); No. 2,250,028, (Miller); No. 3,112,781, (Popeil); No. 2,661,039, (Davis, et al); No. 3,924,501, (Cohen).

However, a study of slicers and dicers in actual use, either in homes or in commercial establishments, shows that, apparently, only one of the devices covered by those patents has been accepted. Further, the consumer use of such devices is very limited. One of the reasons for such limited use is that, the devices shown in the listed patents and those in actual use today, but not in the patents, require relatively large forces to be applied to the upper cutting die, which in all cases in the prior art has the cutting edges of such die terminating in a common cutting-edge plane. Experience shows that if an onion, for example, is placed in a slicer having such an upper cutting die, the force required to pass the die through the cutting knives while slicing the onion is beyond the strength of the ordinary housewife. Thus, the housewife resorts to ordinary slicing with a knife and, to her, the prior art slicers and dicers have little utility.

It is an object of this invention, therefore, to overcome the general inconveniences and disadvantages of the prior art devices, as set forth hereinbefore.

It is a further object of the present invention to provide a produce cutter which requires minimal operating force.

It is a still further object of the present invention to provide a device which can, alteratively, slice or dice agricultural produce with ease and simplicity.

SUMMARY OF THE INVENTION

Stated succinctly, by providing in an agricultural produce slicer or dicer a cutting die in which the face of the die does not lie in a single plane but, instead, is concave so as to transfer any applied force over a significant area of the produce to be sliced, the produce is forced through the cooperating interstices in fixed knife racks (which may also have a concave contour facing the movable die), and the produce is sliced, with maximum ease and minimum force.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description taken in conjunction with the accompanying drawings, in which:

DESCRIPTION OF THE PREFERRED EMBODIMENT

Figure 1:
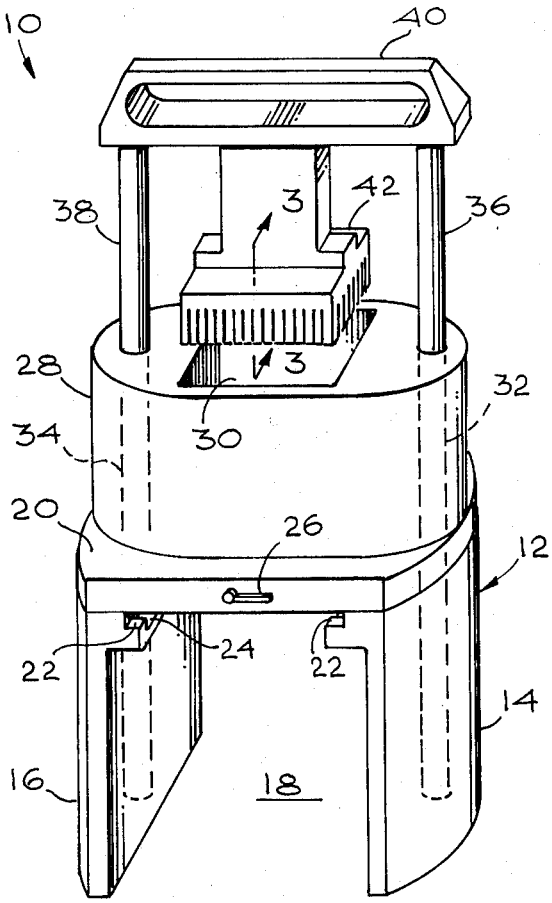
FIG. 1 is an isometric, elevational view of a produce cutter according to the present invention, with the fixed knives removed.

In FIG. 1, produce cutter 10 has base 12 including legs 14 and 16 separated by receptacle receiving space 18 for inserting a cut-produce tray to hold and remove sliced produce.

Base 12 has an upper platform 20 carrying, in dependent fashion, knife-rack grooves 22 and 24 for receiving the knife racks described in connection with FIG. 2. Latch 26 is provided for securing the knife racks in position.

Platform 20 also includes chamber body 28 which has produce-receiving chamber 30, therein. Chamber 30 extends through chamber body 28 and the remainder of platform 20 into the region of knife-rack grooves 22 and 24, which grooves, during operation of cutter 10, carry the knife racks of FIG. 2.

Chamber body 28 and its associated platform 20 have a pair of openings 32 and 34 therethrough for receiving guide rails 36 and 38, in snug, but slidable, fashion. Guide rails 36 and 38 terminate at their upper ends in handle 40 which carries thereon movable cutting die 42 the outer dimensions of which in the horizontal plane are slightly less than the inner dimensions, in the horizontal plane of chamber 30 so as to assure a snug but sliding fit between movable die 42 and the walls of chamber 30, to prevent skewing of die 42 when it is in pressured engagement with a product to be sliced or diced. The details of die 42 may be determined more clearly from FIGS. 3 and 4.

Figure 2:
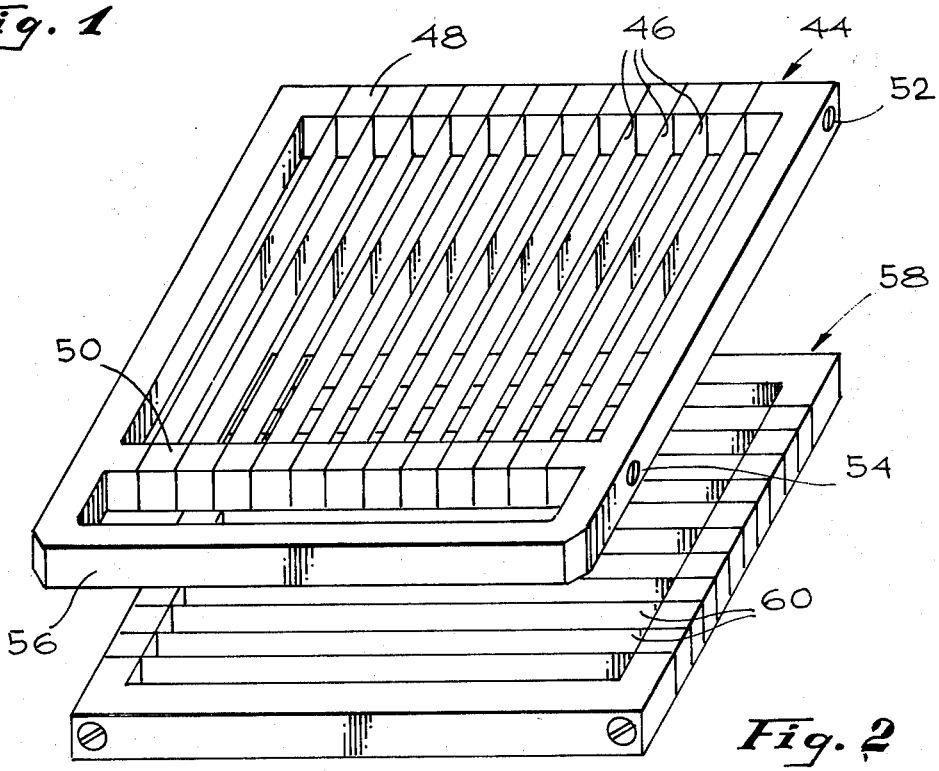
FIG. 2 is an isometric view of the fixed knives, for one operation of the device of FIG. 1, shown in exploded relationship with respect to each other.

In FIG. 2, upper knife rack 44 includes a plurality of knives 46 secured at their extremities, in rigid fashion, by frame elements 48 and 50 through which bolts 52 and 54, respectively, pass for removably securing knives 46 in knife rack 44. Knife rack 44 also includes handle portion 56 for removing and inserting rack 44 in grooves 22 of FIG. 1. Knives 46 are, preferably, of stainless steel, although it is possible to use other hardened, rust-resistant materials and to die-cast the entire rack and knives for a low-cost cutter for consumer use.

Knife rack 58 is similar to rack 44 but does not have a handle portion. It is square in configuration so that it may be oriented with its knives 60 aligned with knives 46, when cutter 10 is to be used for slicing (as for slicing french-fries), or with knives 60 oriented at right angles to knives 46, as when dicing of a product is desired. Knife rack 58 is inserted first in grooves 22 but ultimately comes to rest in grooves 24 directly in line with chamber 30. Knife rack 44 is inserted in grooves 22 and, in its operating position, has knives 46 aligned with and directly below changer 30; and directly above the knives of rack 58. The turning of lever 26 to overlap the outer edge of handle portion 56 holds knife rack against outward movement and thus, with the aid of grooves 22 and 24, holds knife racks 44 and 58 in fixed relationship to each other and with respect to die 42 during operation of cutter 10.

Figure 3:
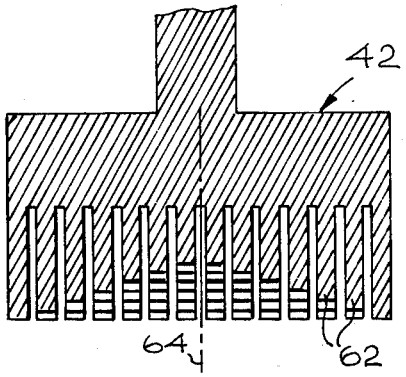
FIG. 3 is a cross-sectional view taken along the line 3—3 in FIG. 1.

In FIG. 3, elements 62 of die 42 are shown to be progressively shortened as you move from the outer to the inner ones of elements 62. In experimental use successive elements have been reduced by 0.070 inch in length moving from the outside edges towards the center of die 42. The concavity has a generally pyramidal shape in FIG. 3 but could equally as well have a generally spherical shape. In any event the concavity is generally symmetrical around an axis 64. Die 42 may be die cast from an aluminum alloy or formed with a reinforced plastic, as may the remainder of device 10, save knives 46 and 60.

Figure 4:
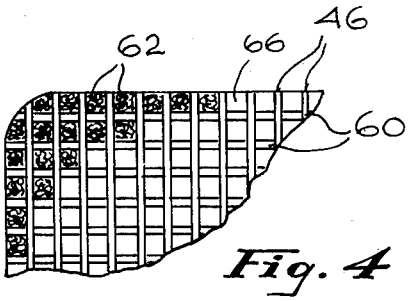
FIG. 4 is a partial view from the bottom of the device of FIG. 1 with the knife racks of FIG. 2 installed.

In FIG. 4, die elements 62 may be seen engaging interstices 66 formed by the positioning of knives 46 at right angles to knives 60. This positioning produces dicing of the produce inserted in chamber 30. By rotating knife rack 58 ninety degrees its knives will be aligned with those of rack 44 and, upon downward movement of handle 40, any produce placed in chamber 30 will be sliced, rather than diced.

Device 10 may be motorized by coupling an electrical motor through a reciprocating arm to handle 40, for example. Rack and pinion means may, alternatively, be used.

While a particular embodiment of the invention has been shown and described it is clear that alternative, but similar, approaches may be used to achieve the desired ends of this invention. It is the intention of the appended claims to cover all such alternative approaches.

I claim:

1. An improved produce cutter including, in combination:

a base portion having a produce-receiving chamber therein, said chamber having a first internal width dimension and a first internal length dimension;

a first knife rack supported in said base portion in alignment with said chamber and in communication therewith and having a second width dimension and a second length dimension, each at least equal to a respective one of said first dimensions, said first knife rack having a first plurality of mutually parallel knives each having thickness and all having their upper edges lying in a common first cutting plane, said knives being spaced by a third dimension;

a cutting die having a plurality of die elements, each of square cross section and spaced from the other by at least said knife thickness, said elements being disposed symmetrically about a center line of said cutting die and each having a flat outer end which, in operation, is parallel to and facing said cutting plane, each such outer end having cross-sectional dimensions which are less than said third dimension;

said cutting die having overall transverse dimensions which are less than said first internal width and length dimensions and being supported slidably in said base portion with said die elements aligned with the spaces between said knives for movement of said die elements into and out of said chamber in a direction normal to said cutting plane;

the lengths of said die elements increasing symmetrically over 360° and incrementally outwardly from said center line to the edges of said cutting die;

and cutting-die moving means coupled to said cutting die for imparting motion thereto.

2. Apparatus according to claim 1 in which said cutting knives are individually and separately supported in said knife rack.

3. Apparatus according to claim 1 in which said base portion includes a pair of grooves for receiving said knife rack.

4. Apparatus according to claim 1 which includes, in addition, a second knife rack supported in said base portion and including a second plurality of mutually parallel knives of equal thickness to and spaced equally to said knives in said first plurality and having their cutting edges aligned to form a second cutting plane parallel to said first cutting plane, said second plurality of cutting knives being oriented at 90° to said first plurality of knives.

5. Apparatus according to claim 4 including, in addition, means for securing said second knife rack in position in said base.

6. Apparatus according to claim 5 in which said second knife rack has a handle portion.

* * * * *